US011135844B2

(12) United States Patent
Takabe et al.

(10) Patent No.: US 11,135,844 B2
(45) Date of Patent: Oct. 5, 2021

(54) LIQUID DISCHARGE HEAD AND PRINTER

(71) Applicant: Seiko Epson Corporation, Tokyo (JP)

(72) Inventors: Motoki Takabe, Shiojiri (JP); Yasuhiro Itayama, Kai (JP); Koji Sumi, Shiojiri (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 16/851,198

(22) Filed: Apr. 17, 2020

(65) Prior Publication Data

US 2020/0331268 A1 Oct. 22, 2020

(30) Foreign Application Priority Data

Apr. 19, 2019 (JP) ..... JP2019-079980

(51) Int. Cl.
*B41J 2/14* (2006.01)

(52) U.S. Cl.
CPC ..... *B41J 2/14233* (2013.01)

(58) Field of Classification Search
None
See application file for complete search history.

(56) References Cited

U.S. PATENT DOCUMENTS

2004/0155559 A1 8/2004 Ifuku et al.
2009/0273654 A1* 11/2009 Kazama ..... H01L 41/0973 347/71
2015/0084486 A1 3/2015 Eguchi
2015/0349240 A1* 12/2015 Mizukami ..... B41J 2/1645 347/70

FOREIGN PATENT DOCUMENTS

JP 2006-173646 A 6/2006
JP 2015-193228 A 11/2015
JP 5817926 B2 11/2015

* cited by examiner

*Primary Examiner* — Erica S Lin
(74) *Attorney, Agent, or Firm* — Harness, Dickey & Pierce, P.L.C.

(57) ABSTRACT

Provided is a liquid discharge head that includes a nozzle plate provided with a nozzle hole that discharges a liquid, a silicon substrate provided with a pressure generating chamber that communicates with the nozzle hole, a vibration plate provided on the silicon substrate, and a piezoelectric element that is provided on the vibration plate and changes a volume of the pressure generating chamber. The piezoelectric element includes a piezoelectric layer including a composite oxide of a perovskite structure containing lead, zirconium, and titanium. A difference between a peak position derived from a (100) surface of the piezoelectric layer and a peak position derived from a (220) surface of the silicon substrate in an X-ray diffraction of the piezoelectric layer is less than 25.00°.

5 Claims, 4 Drawing Sheets

LIQUID DISCHARGE HEAD AND PRINTER

The present application is based on, and claims priority from JP Application Serial Number 2019-079980, filed Apr. 19, 2019, the disclosure of which is hereby incorporated by reference herein in its entirety.

BACKGROUND

1. Technical Field

The present disclosure relates to a liquid discharge head and a printer.

2. Related Art

A representative example of a liquid discharge head includes an inkjet recording head in which a vibration plate is deformed by a piezoelectric element to pressurize ink in a pressure generating chamber and discharge the ink in ink droplets from a nozzle hole. JP-A-2015-193228 (Patent Literature 1) discloses an example of the piezoelectric element used in the inkjet recording head. The piezoelectric element includes a piezoelectric layer interposed between two electrodes. The piezoelectric layer is formed of a piezoelectric material such as a crystallized dielectric material having an electromechanical conversion function.

A displacement amount of the vibration plate used in the above-described liquid discharge head needs to be large.

SUMMARY

An aspect of a liquid discharge head according to the present disclosure includes a nozzle plate provided with a nozzle hole that discharges a liquid, a silicon substrate provided with a pressure generating chamber that communicates with the nozzle hole, a vibration plate provided on the silicon substrate, and a piezoelectric element that is provided on the vibration plate and changes a volume of the pressure generating chamber. The piezoelectric element includes a piezoelectric layer including a composite oxide of a perovskite structure containing lead, zirconium, and titanium. A difference between a peak position derived from a (100) surface of the piezoelectric layer and a peak position derived from a (220) surface of the silicon substrate in an X-ray diffraction of the piezoelectric layer is less than 25.00°.

In the aspect of the liquid discharge head, $y \leq -0.50x + 25.21$ may be satisfied, in which a ratio Ti/(Zr+Ti) of an atomic concentration of titanium to a sum of the atomic concentration of titanium and an atomic concentration of zirconium in the piezoelectric layer is x, and the difference is y.

In the aspect of the liquid discharge head, a ratio Ti/(Zr+Ti) of an atomic concentration of titanium to a sum of the atomic concentration of titanium and an atomic concentration of zirconium in the piezoelectric layer may be 0.55 or less.

In the aspect of the liquid discharge head, the difference may be 24.80° or more.

In the aspect of the liquid discharge head, the vibration plate may include a zirconium oxide layer.

An aspect of a printer according to the present disclosure includes the liquid discharge head according to the aspect, a conveyance mechanism that moves a recording medium relative to the liquid discharge head, and a control unit that controls the liquid discharge head and the conveyance mechanism.

DESCRIPTION OF EXEMPLARY EMBODIMENTS

Hereinafter, an embodiment of the present disclosure will be described in detail with reference to the drawings. The embodiment described below does not in any way limit contents of the present disclosure described in the claims. Not all configurations described below are necessarily essential components of the present disclosure.

1. Liquid Discharge Head

1.1. Configuration

Figure 1:
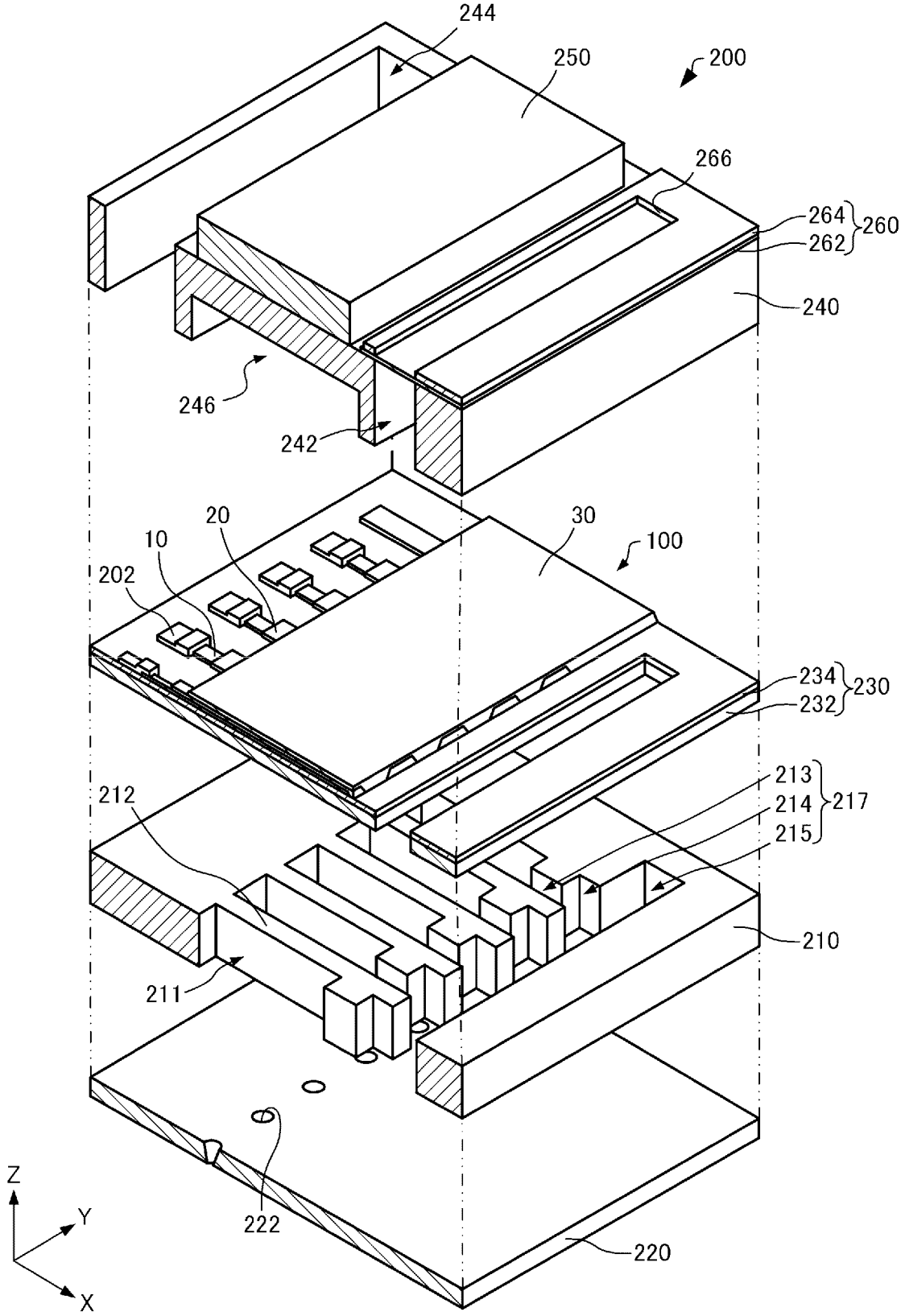
FIG. 1 is an exploded perspective view schematically showing a liquid discharge head according to an embodiment.
Figure 2:
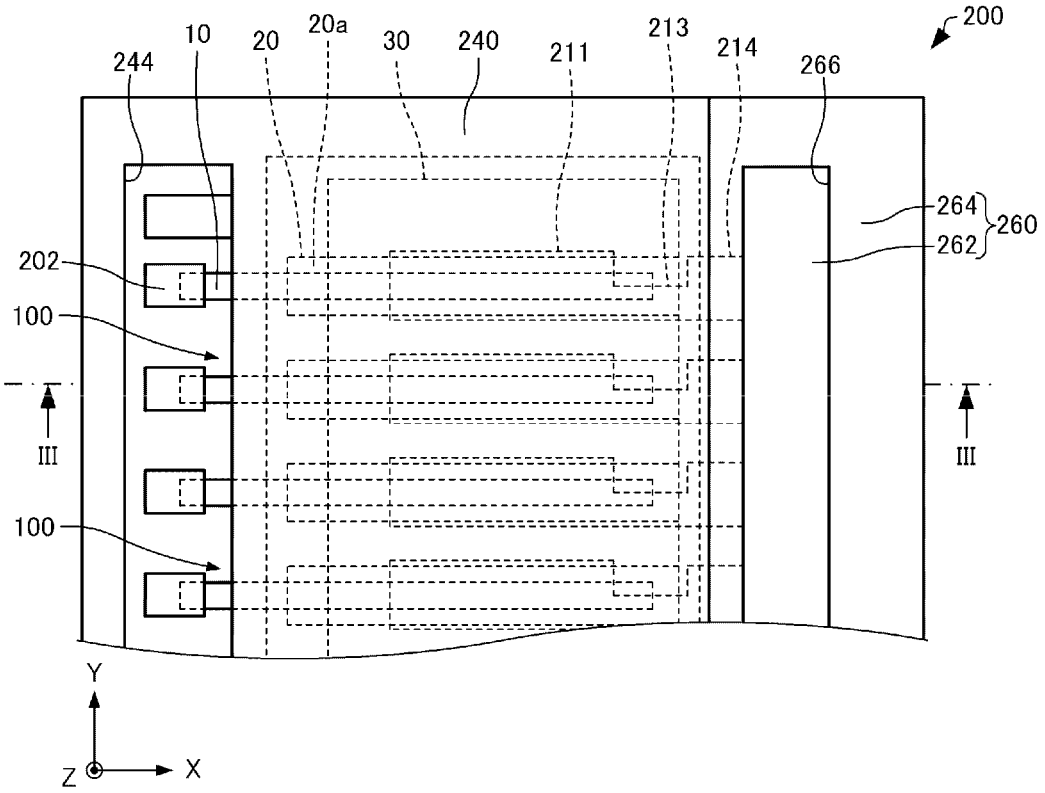
FIG. 2 is a plan view schematically showing the liquid discharge head according to the present embodiment.
Figure 3:
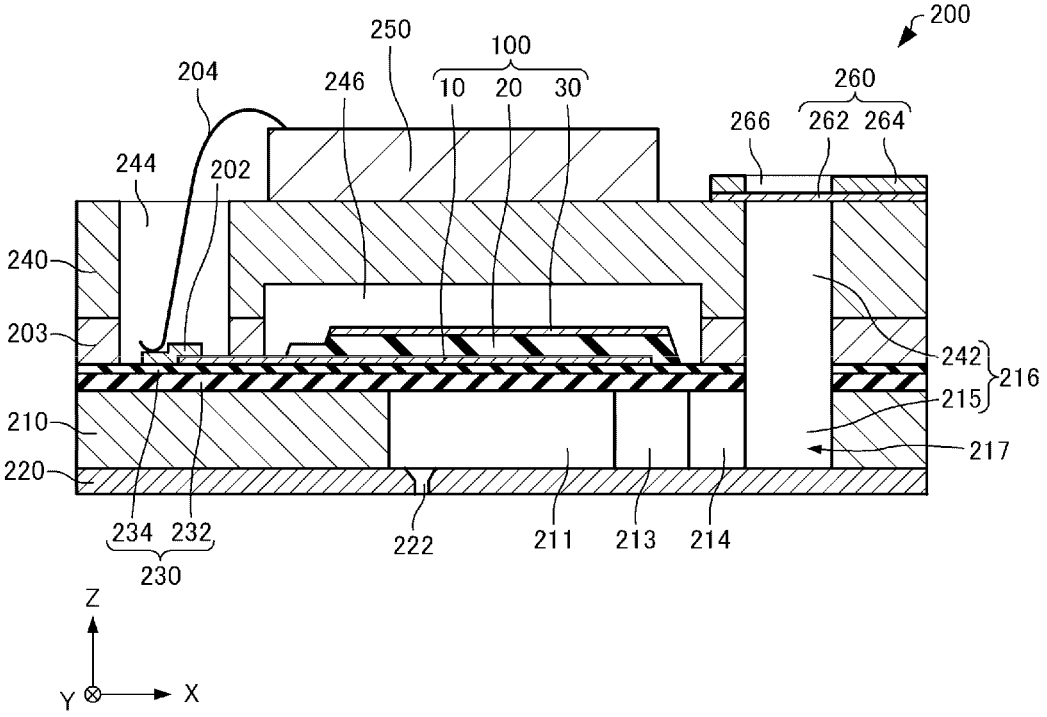
FIG. 3 is a cross-sectional view schematically showing the liquid discharge head according to the present embodiment.

First, a liquid discharge head according to the present embodiment will be described with reference to the drawings. FIG. 1 is an exploded perspective view schematically showing a liquid discharge head 200 according to the present embodiment. FIG. 2 is a plan view schematically showing the liquid discharge head 200 according to the present embodiment. FIG. 3 is a cross-sectional view taken along a line III-III in FIG. 2 and schematically shows the liquid discharge head 200 according to the present embodiment. FIGS. 1 to 3 show an X axis, a Y axis, and a Z axis as three axes orthogonal to each other.

As shown in FIGS. 1 to 3, the liquid discharge head 200 includes, for example, a piezoelectric element 100, a silicon substrate 210, a nozzle plate 220, a vibration plate 230, a protective substrate 240, a circuit board 250, and a compliance substrate 260. The circuit board 250 is not shown in FIG. 2 for convenience.

Pressure generating chambers 211 are provided in the silicon substrate 210. The pressure generating chambers 211 are partitioned by a plurality of partition walls 212. Volumes of the pressure generating chambers 211 are changed by the piezoelectric element 100.

A first communication passage 213 and a second communication passage 214 are provided at an end in a +X axis direction of the pressure generating chamber 211 in the silicon substrate 210. An opening area of the first communication passage 213 is reduced by narrowing, in a Y axis direction, the end in the +X axis direction of the pressure generating chamber 211. Width in the Y axis direction of the second communication passage 214 is, for example, the same as width in the Y axis direction of the pressure generating chamber 211. A third communication passage 215 communicating with a plurality of second communication passages 214 is provided in the +X axis direction of the second communication passage 214. The third communication passage 215 forms a part of a manifold 216. The manifold 216 serves as a common liquid chamber for the pressure generating chambers 211. In this manner, the silicon substrate 210 is provided with the pressure generating chambers 211 and a supply flow path 217 including the first communication passage 213, the second communication passage 214, and the third communication passage 215. The supply flow path 217 communicates with the pressure generating chambers 211 and supplies liquid to the pressure generating chambers 211.

The nozzle plate 220 is provided on a surface at one side of the silicon substrate 210. A material of the nozzle plate 220 is, for example, steel use stainless (SUS). The nozzle plate 220 is bonded to the silicon substrate 210 by an adhesive, a heat welding film, or the like. The nozzle plate 220 is provided with a plurality of nozzle holes 222 along the Y axis. The nozzle holes 222 communicate with the pressure generating chamber 211 and discharge liquid.

The vibration plate 230 is provided on a surface at the other side of the silicon substrate 210. The vibration plate 230 includes, for example, a silicon oxide layer 232 provided on the silicon substrate 210 and a zirconium oxide layer 234 provided on the silicon oxide layer 232. The vibration plate 230 includes only one zirconium oxide layer 234. Thickness of the zirconium oxide layer 234 is, for example, 350 nm or more and 450 nm or less.

The piezoelectric element 100 is provided, for example, on the vibration plate 230. A plurality of piezoelectric elements 100 are provided. The number of piezoelectric elements 100 is not particularly limited. The piezoelectric element 100 changes volumes of the pressure generating chambers 211.

In the liquid discharge head 200, the vibration plate 230 and a first electrode 10 are displaced by a deformation of a piezoelectric layer 20 having an electromechanical conversion characteristic. A detailed configuration of the piezoelectric element 100 will be described below.

The protective substrate 240 is bonded to the silicon substrate 210 by an adhesive 203. The protective substrate 240 is provided with a through hole 242. The through hole 242 passes through the protective substrate 240 in a Z axis direction and communicates with the third communication passage 215 in FIGS. 1 to 3. The through hole 242 and the third communication passage 215 form the manifold 216 that serves as the common liquid chamber for the pressure generating chambers 211. The protective substrate 240 is further provided with a through hole 244 that passes through the protective substrate 240 in the Z axis direction. An end portion of a lead electrode 202 is positioned in the through hole 244.

An opening 246 is provided in the protective substrate 240. The opening 246 is a space in which driving of the piezoelectric element 100 is prevented from being hindered. The opening 246 may be sealed or not sealed.

The circuit board 250 is provided on the protective substrate 240. The circuit board 250 includes a semiconductor integrated circuit (IC) that drives the piezoelectric element 100. The circuit board 250 and the lead electrode 202 are electrically coupled via a connection wire 204.

The compliance substrate 260 is provided on the protective substrate 240. The compliance substrate 260 includes a sealing layer 262 provided on the protective substrate 240 and a fixing plate 264 provided on the sealing layer 262. The sealing layer 262 seals the manifold 216 and has flexibility or the like. The fixing plate 264 is provided with a through hole 266. The through hole 266 passes through the fixing plate 264 in the Z axis direction. The through hole 266 is provided at a position overlapping the manifold 216 as viewed in the Z axis direction.

1.2. Piezoelectric Element

As shown in FIGS. 2 and 3, the piezoelectric element 100 includes the first electrode 10, the piezoelectric layer 20, and a second electrode 30.

A shape of the first electrode 10 is, for example, a layer shape. Thickness of the first electrode 10 is, for example, 3 nm or more and 200 nm or less. Examples of the first electrode 10 include a metal layer such as a platinum layer, an iridium layer, and a ruthenium layer, a conductive oxide layer of the metal layer, a lanthanum nickelate ($LaNiO_3$: LNO) layer, and a strontium ruthenate ($SrRuO_3$: SRO) layer. The first electrode 10 may have a structure in which a plurality of layers in the above-described examples are stacked. The first electrode 10 may include titanium.

The first electrode 10 is provided for each pressure generating chamber 211 separately. Width in the Y axis direction of the first electrode 10 is smaller than width in the Y axis direction of the pressure generating chamber 211. Length in the X axis direction of the first electrode 10 is larger than length in the X axis direction of the pressure generating chamber 211. In the X axis direction, both ends of the first electrode 10 are positioned sandwiching both ends of the pressure generating chamber 211. The lead electrode 202 is coupled to an end in the −X axis direction of the first electrode 10.

The first electrode 10 is an electrode that applies a voltage to the piezoelectric layer 20. The first electrode 10 is a lower electrode provided under the piezoelectric layer 20.

The piezoelectric layer 20 is provided on the first electrode 10. The piezoelectric layer 20 is provided between the first electrode 10 and the second electrode 30. Thickness of the piezoelectric layer 20 is, for example, 500 nm or more and 5 μm or less. The piezoelectric layer 20 can be deformed by applying a voltage between the first electrode 10 and the second electrode 30.

The piezoelectric layer 20 includes a composite oxide of a perovskite structure containing lead (Pb), zirconium (Zr), and titanium (Ti). The piezoelectric layer 20 is a PZT layer formed of PZT. The piezoelectric layer 20 may include an additive other than lead, zirconium, titanium, and oxygen (O). That is, the piezoelectric layer 20 may be a PZT layer to which an additive is added.

Width in the Y axis direction of the piezoelectric layer 20 is, for example, larger than the width in the Y axis direction of the first electrode 10. Length in the X axis direction of the piezoelectric layer 20 is, for example, larger than the length in the X axis direction of the pressure generating chamber 211. The end in the +X axis direction of the first electrode 10 is positioned, for example, between an end in the +X axis direction of the piezoelectric layer 20 and the end in the +X axis direction of the pressure generating chamber 211. The end in the +X axis direction of the first electrode 10 is covered by the piezoelectric layer 20. On the other hand, an end in the −X axis direction of the piezoelectric layer 20 is positioned, for example, between the end in the −X axis direction of the first electrode 10 and the end in the −X axis direction of the pressure generating chamber 211. The end in the −X axis direction of the first electrode 10 is not covered by the piezoelectric layer 20.

The second electrode 30 is provided on the piezoelectric layer 20. A shape of the second electrode 30 is, for example, a layer shape. Thickness of the second electrode 30 is, for example, 15 nm or more and 300 nm or less. Examples of the second electrode 30 include a metal layer such as an iridium layer, a platinum layer, and a ruthenium layer, a conductive oxide layer of the metal layer, a lanthanum nickelate layer, and a strontium ruthenate layer. The second electrode 30 may have a structure in which a plurality of layers in the above-described examples are stacked.

The second electrode 30 is, for example, continuously provided on the piezoelectric layer 20 and the vibration plate 230. The second electrode 30 is an electrode common to the plurality of piezoelectric elements 100.

The second electrode 30 is another electrode that applies a voltage to the piezoelectric layer 20. The second electrode 30 is an upper electrode provided on the piezoelectric layer 20.

1.3. XRD Evaluation

In an X-ray diffraction (XRD) of the piezoelectric layer 20, a difference Δ between a peak position derived from a (100) surface of the piezoelectric layer 20 and a peak position derived from a (220) surface of the silicon substrate 210 is less than 25.00°, preferably 24.80° or more and less than 25.00°, and more preferably 24.86° or more and 24.95° or less. Specifically, the difference Δ is a value obtained by subtracting the peak position derived from the (100) surface of the piezoelectric layer 20 from the peak position derived from the (220) surface of the silicon substrate 210. For example, the difference Δ can be calculated by an XRD measurement in a region 20*a* that is a portion of the piezoelectric layer 20 provided on the vibration plate 230 and is not covered by the second electrode 30 as shown in FIG. 2. A region where the XRD measurement is performed is not particularly limited as long as the difference Δ can be calculated.

Here, a crystal structure of the piezoelectric layer 20 is regarded as a pseudo cubic crystal in terms of surface orientation. This is for the convenience of description since the crystal structure of the piezoelectric layer 20 having a thin film shape is difficult to accurately identify. Although the crystal structure of the piezoelectric layer 20 is regarded as a pseudo cubic crystal in terms of surface orientation, the crystal structure of the piezoelectric layer 20 may be an $ABO_3$ structure having lower symmetry than the pseudo cubic crystal, for example, a tetragonal crystal, an orthorhombic crystal, a monoclinic crystal, and a rhombohedral crystal.

The piezoelectric layer 20, for example, (100) may be oriented. Here, the "(100) may be oriented" refers to that an orientation ratio F represented by the following formula (1) is 70% or more when a peak intensity derived from the (100) surface is $I_{(100)}$, a peak intensity derived from a (110) surface is $I_{(100)}$, and a peak intensity derived from a (111) surface is $I_{(111)}$ in an X-ray diffraction intensity curve obtained by the XRD measurement.

$$F=I_{(100)}/(I_{(100)}+I_{(110)}+I_{(111)})\times 100 \quad (1)$$

A peak position derived from the (100) surface of the piezoelectric layer 20 is 2θ=22.00° to 22.20°. A peak position derived from the (220) surface of the silicon substrate 210 is 2θ=47.03°.

The zirconium oxide layer 234 of the vibration plate 230 generates a stress on the piezoelectric layer 20. Specifically, when the zirconium oxide layer 234 is formed by thermally oxidizing a zirconium layer, the zirconium oxide layer 234 expands to push the piezoelectric layer 20 so as to generate a compressive stress on the piezoelectric layer 20. The peak position derived from the (100) surface of the piezoelectric layer 20 changes depending on a magnitude of the compressive stress.

For example, the following formula (2) is satisfied in the piezoelectric layer 20, in which a ratio Ti/(Zr+Ti) of an atomic concentration of titanium to a sum of the atomic concentration of titanium and an atomic concentration of zirconium is x, and the difference Δ is y.

$$y\leq -0.50x+25.21 \quad (2)$$

The ratio Ti/(Zr+Ti) may be, for example, 0.55 or less, and preferably be 0.35 or more and 0.55 or less. The ratio Ti/(Zr+Ti) can be obtained, for example, by energy dispersive X-ray spectrometry (EDX).

1.4. Characteristic

The liquid discharge head 200 has the following characteristics, for example.

In the liquid discharge head 200, the difference Δ between the peak position derived from the (100) surface of the piezoelectric layer 20 and the peak position derived from the (220) surface of the silicon substrate in the XRD of the piezoelectric layer 20 is less than 25.00°. Therefore, as shown in "5. Experimental Example" which will be described below, a displacement amount of the vibration plate 230 can be large compared with a case in which the difference Δ is 25.00° or more in the liquid discharge head 200.

In the liquid discharge head 200, formula (2) is satisfied in the piezoelectric layer 20, in which the ratio Ti/(Zr+Ti) of the atomic concentration of titanium to the sum of the atomic concentration of titanium and the atomic concentration of zirconium is x, and the difference Δ is y. Therefore, as shown in "5. Experimental Example" which will be described below, the displacement amount of the vibration plate 230 can be large compared with a case in which a relationship of y>−0.50x+25.21 is satisfied in the liquid discharge head 200.

The ratio Ti/(Zr+Ti) is 0.55 or less in the liquid discharge head 200. Therefore, the liquid discharge head 200 may have a good repetition characteristic compared with a case in which the ratio Ti/(Zr+Ti) is greater than 0.55. Here, the "repetition characteristic" refers to a characteristic when the piezoelectric element is repeatedly operated to repeatedly displace the vibration plate. When the piezoelectric element is repeatedly operated, the piezoelectric element is hardly deformed, and the displacement amount of the vibration plate decreases. Such a decrease in the displacement amount of the vibration plate can be prevented in the liquid discharge head 200 and a good repetition characteristic can be obtained.

2. Method for Manufacturing Liquid Discharge Head

Next, a method for manufacturing the liquid discharge head 200 according to the present embodiment will be described with reference to the drawings.

As shown in FIG. 3, the vibration plate 230 is formed on the silicon substrate 210. Specifically, the silicon substrate 210 is thermally oxidized to form the silicon oxide layer 232. Next, a zirconium layer is formed on the silicon oxide layer 232. The zirconium layer is formed by, for example, a sputtering method. Next, the zirconium layer is thermally oxidized to form the zirconium oxide layer 234. Thermal oxidation temperature of the zirconium layer is, for example, 850° C. or more and 950° C. or less. Next, the zirconium oxide layer 234 is heat treated at 750° C. or less. It should be noted that the heat treatment may not be performed. The vibration plate 230 can be formed by steps described above.

Next, the first electrode 10 is formed on the vibration plate 230. The first electrode 10 is formed by a sputtering method, a vacuum deposition method, or the like. Next, the first electrode 10 is patterned by, for example, photolithography and etching.

Next, the piezoelectric layer 20 is formed on the first electrode 10. The piezoelectric layer 20 is formed by a chemical solution deposition (CSD) such as a sol-gel method or a metal organic deposition (MOD) method. A method for forming the piezoelectric layer 20 will be described below.

First, a metal complex containing lead, a metal complex containing zirconium, and a metal complex containing titanium are dissolved or dispersed in an organic solvent to adjust a precursor solution.

An example of the metal complex containing lead includes lead acetate. Examples of the metal complex containing zirconium include zirconium butoxide, zirconium acetylacetonate, zirconium tetraacetylacetonate, zirconium monoacetylacetonate, and zirconium bisacetylacetonate. An example of the metal complex containing titanium includes titanium tetra-i-propoxide.

Examples of a solvent of the metal complexes include propanol, butanol, pentanol, hexanol, octanol, polyethylene glycol, propylene glycol, octane, decane, cyclohexane, xylene, toluene, tetrahydrofuran, acetic acid, octylic acid, 2-n-butoxyethanol, n-octane or a mixed solvent thereof.

Next, the adjusted precursor solution is applied onto the first electrode 10 using a spin coating method or the like to form a precursor layer. Next, the precursor layer is heated at, for example, 130° C. or more and 250° C. or less and dried for a certain period of time. The dried precursor layer is further heated at, for example, 300° C. or more and 550° C. or less and degreased by maintaining the heating for a certain period of time. Next, the degreased precursor layer is crystallized by being fired at, for example, 700° C. or more and 800° C. or less.

Then, a series of steps described above from application of the precursor solution to firing of the precursor layer are repeated a plurality of times. Therefore, the piezoelectric layer 20 can be formed. Next, the piezoelectric layer 20 is patterned by, for example, photolithography and etching.

A heating device used for drying and degreasing the precursor layer is, for example, a hot plate. A heating device used for firing the precursor layer is, for example, a rapid thermal annealing (RTA) device.

Next, the second electrode 30 is formed on the piezoelectric layer 20. The second electrode 30 is formed by a sputtering method, a vacuum deposition method, or the like. Next, the second electrode 30 is patterned by, for example, photolithography and etching.

The piezoelectric element 100 is formed on the vibration plate 230 by steps described above.

Next, etching is performed on a surface of the silicon substrate 210 opposite to a surface on which the piezoelectric element 100 is provided to form the pressure generating chamber 211 and the supply flow path 217 in the silicon substrate 210.

Next, the nozzle plate 220 provided with the nozzle holes 222 is bonded to the silicon substrate 210 by an adhesive (not shown) or the like. Next, the protective substrate 240 provided with the circuit board 250 and the compliance substrate 260 is bonded to the vibration plate 230 by the adhesive 203.

The liquid discharge head 200 can be manufactured by steps described above.

3. Modification of Liquid Discharge Head

Figure 4:
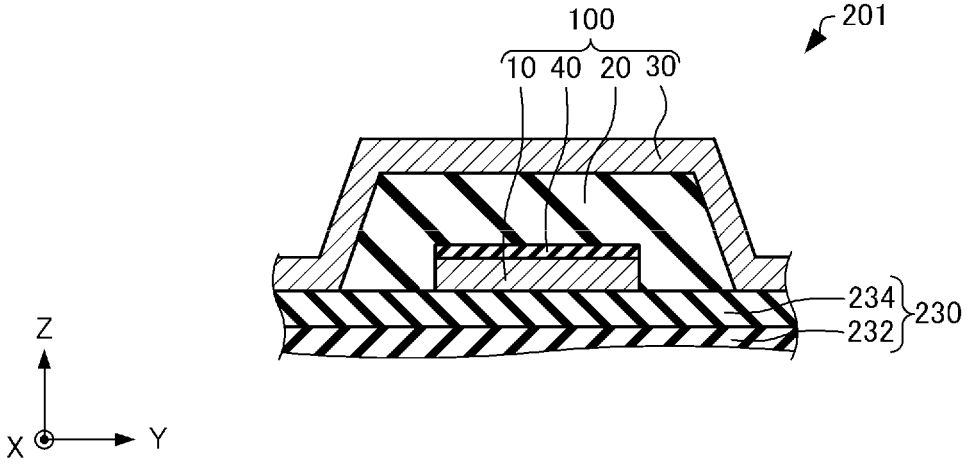
FIG. 4 is a cross-sectional view schematically showing a liquid discharge head according to a modification of the present embodiment.

Next, a liquid discharge head according to a modification of the present embodiment will be described with reference to the drawings. FIG. 4 is a cross-sectional view schematically showing a liquid discharge head 201 according to the modification of the embodiment. Members other than the piezoelectric element 100 and the vibration plate 230 are not shown in FIG. 4 for convenience.

Hereinafter, a configuration of the liquid discharge head 201 according to the modification of the present embodiment different from the example of the liquid discharge head 200 according to the above-described embodiment will be described, and a description of the same configuration will be omitted.

As shown in FIG. 4, the liquid discharge head 201 is different from the above-described liquid discharge head 200 in that the piezoelectric element 100 includes a lead titanate ($PbTiO_3$: PTO) layer 40.

The lead titanate layer 40 is provided between the first electrode 10 and the piezoelectric layer 20. The lead titanate layer 40 may have a function of generating a stress on the piezoelectric layer 20. Although not shown, a lead oxide (PbO) layer instead of the lead titanate layer 40 may be provided between the first electrode 10 and the piezoelectric layer 20.

4. Printer

Figure 5:
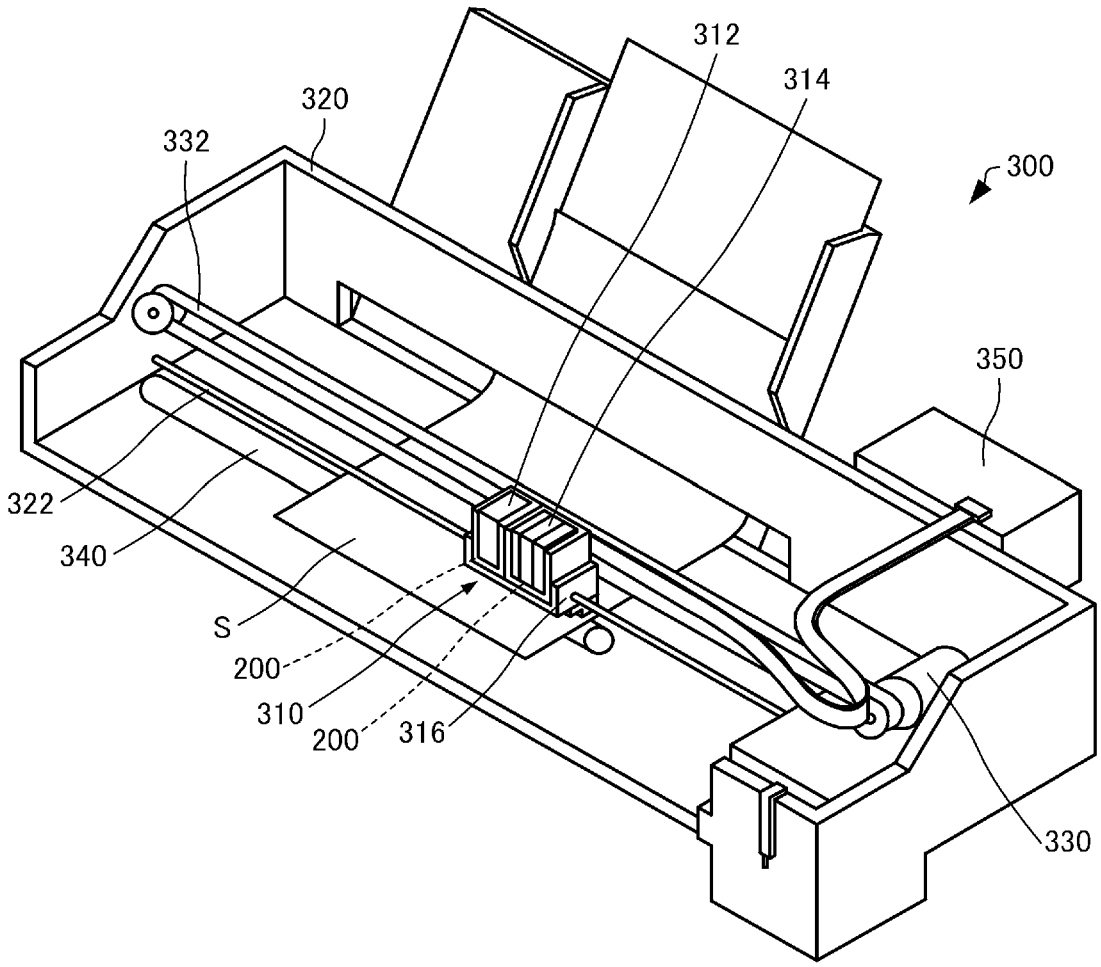
FIG. 5 is a perspective view schematically showing a printer according to the present embodiment.

Next, a printer according to the present embodiment will be described with reference to the drawings. FIG. 5 is a perspective view schematically showing a printer 300 according to the present embodiment.

The printer 300 is an inkjet printer. As shown in FIG. 5, the printer 300 includes a head unit 310. The head unit 310 includes, for example, the liquid discharge head 200. The number of the liquid discharge head 200 is not particularly limited. Cartridges 312 and 314 that form a supply unit are detachably provided in the head unit 310. A carriage 316 on which the head unit 310 is mounted moves freely in a shaft direction on a carriage shaft 322 that is attached to a device main body 320, and discharges liquid supplied from a liquid supply unit.

Here, the liquid may be a material in a state in which a substance is in a liquid phase. The liquid also includes a liquid material such as a sol or a gel. The liquid includes not only liquid which is a state of a substance but also a matter in which particles of a functional material formed of a solid matter such as a pigment or metal particles are dissolved, dispersed, or mixed in a solvent. Representative examples of the liquid include ink, a liquid crystal emulsifier, and the like. The ink includes general water-based ink, oil-based ink, and various liquid compositions such as gel ink and hot melt ink.

In the printer 300, a driving force of a drive motor 330 is transmitted to the carriage 316 via a plurality of gears (not shown) and a timing belt 332 so as to move the carriage 316 on which the head unit 310 is mounted along the carriage shaft 322. On the other hand, the device main body 320 is provided with a conveyance roller 340 as a conveyance mechanism to move a sheet S which is a recording medium such as paper relative to the liquid discharge head 200. The conveyance mechanism that conveys the sheet S is not limited to the conveyance roller, and may be a belt, a drum, or the like.

The printer 300 includes a printer controller 350 as a control unit to control the liquid discharge head 200 and the conveyance roller 340. The printer controller 350 is electrically coupled to the circuit board 250 of the liquid discharge head 200. Examples of the printer controller 350 include a random access memory (RAM) that temporarily stores various types of data, a read only memory (ROM) that stores a control program, a central processing unit (CPU), and a drive signal generating circuit that generates a drive signal to be supplied to the liquid discharge head 200.

5. Experimental Example

5.1. Sample Preparation

5.1.1. Sample 1

In a sample 1, a silicon substrate was thermally oxidized to form a $SiO_2$ layer on a surface of the silicon substrate. Next, a Zr layer was formed on the $SiO_2$ layer by a sputtering method, and the Zr layer was thermally oxidized at 900° C. to form a $ZrO_2$ layer. Thickness of the $ZrO_2$ layer was 400 nm. In this manner, a vibration plate formed of the $SiO_2$ layer and the $ZrO_2$ layer was formed.

Next, a titanium layer, a platinum layer, and an iridium layer were formed on the vibration plate in order by a sputtering method, and were patterned into a predetermined shape to form a first electrode.

Next, a piezoelectric layer was formed on the first electrode in the following procedure.

Acetic acid and water were weighed and taken into a container, and then lead acetate, zirconium butoxide, titanium tetra-i-propoxide, and polyethylene glycol were weighed, stirred and heated at 90° C. to prepare a PZT precursor solution.

The above-described PZT precursor solution was applied onto the first electrode by a spin coating method to form a PZT precursor layer. Next, the PZT precursor layer was heated in order at 155° C., 275° C., and 530° C. Thereafter, the PZT precursor layer was fired at 747° C. using an RTA device. A series of steps from application of the PZT precursor solution to the firing were repeated 10 times to form a PZT layer.

5.1.2. Sample 2

A sample 2 is similar to the sample 1 except that a heat treatment was performed at 750° C. after the $ZrO_2$ layer was formed and before the first electrode was formed.

5.1.3. Sample 3

A sample 3 is similar to the sample 1 except that a heat treatment was performed at 850° C. after the $ZrO_2$ layer was formed and before the first electrode was formed.

5.1.4. Sample 4

A sample 4 is obtained by powering the PZT layer having a thin film shape in the sample 1.

5.2. Characteristic Evaluation

An XRD measurement was performed on the above-described samples 1 to 4. A measurement was performed on the samples 1, 2, and 4 whose PZT layer ratio Ti/(Zr+Ti) changes.

"D8 DISCOVERS with GADDS" manufactured by Bruker was used in the XRD measurement. The XRD measurement was performed at pipe voltage: 50 kV, pipe current: 100 mA, detector distance: 15 cm, collimator diameter: 0.3 mm, and measurement time: 480 sec. Obtained two-dimensional data was converted into an X-ray analysis intensity curve using attached software at 2θ range: 20° to 80°, χ range: −95° to −85°, step width: 0.02°, and intensity normalization method: bin normalized.

Figure 6:
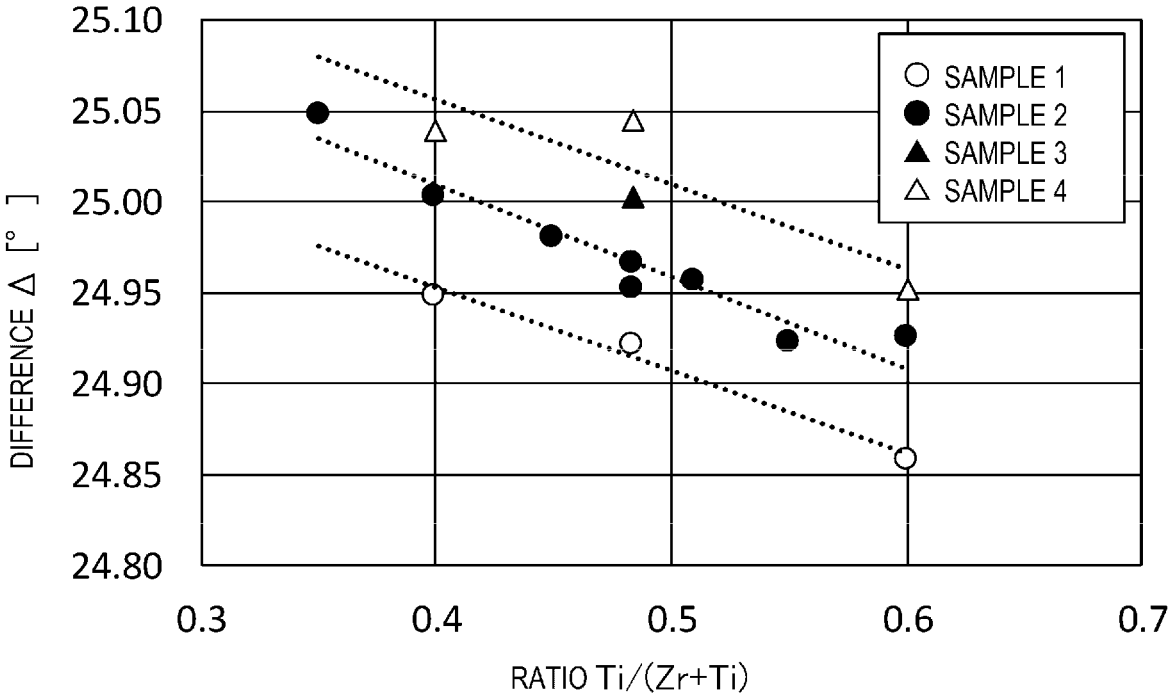
FIG. 6 is a graph showing a relationship between a ratio Ti/(Zr+Ti) in a PZT layer and a difference Δ between peak positions of an X-ray diffraction intensity curve.

FIG. 6 is a graph showing a relationship between the ratio Ti/(Zr+Ti) in the PZT layer and the difference Δ between peak positions in X-ray diffraction intensity curves of the samples 1 to 4. The difference Δ is a value obtained by subtracting the peak position derived from the (100) surface of the PZT layer from the peak position derived from the (220) surface of the silicon substrate.

The ratio Ti/(Zr+Ti) was x and the difference Δ was y in FIG. 6. An approximate curve of three points of the sample 1 satisfied $y=-0.46x+25.14$. An approximate curve of eight points of the sample 2 satisfied $y=-0.50x+25.21$. An approximate curve of three points of the sample 4 satisfied $y=-0.46x+25.24$. The difference Δ of the sample 3 was 25.00°. The approximate curves of the samples 1, 2, and 4 are indicated by broken lines in FIG. 6.

For example, when x=0.48, the difference Δ of the sample 4 was the largest, followed by the difference Δ of the sample 3 and the difference Δ of the sample 2, and the difference Δ of the sample 1 was the smallest in FIG. 6. This order was generated due to a magnitude of a stress generated on the PZT layer by the $ZrO_2$ layer of the vibration plate. The smaller the stress, the larger the difference Δ would be.

Since the sample 4 is a powdered PZT, the PZT is not restrained by the $ZrO_2$ layer. Therefore, the PZT is not subjected to the stress by the $ZrO_2$ layer in the sample 4.

Compared to the sample 1, the stress generated on the PZT layer by the $ZrO_2$ layer is reduced by the heat treatment performed after the $ZrO_2$ layer is formed in the samples 2 and 3. The heat treatment changes a crystal system of the $ZrO_2$ layer in the samples 2 and 3.

Since the sample 1 is not subjected to the heat treatment after the $ZrO_2$ layer is formed, the stress generated on the PZT layer by the $ZrO_2$ layer is larger than the stress in the samples 2 and 3. The heat treatment performed at 747° C. to fire the PZT changes a crystal system of the $ZrO_2$ layer in the sample 1.

Next, an iridium layer was formed on the PZT layer in the samples 1 to 3 and patterned into a predetermined shape to form a second electrode. Next, a mask layer was formed on the silicon substrate, and the mask layer was used as a mask to form a pressure generating chamber by wet etching using an alkaline solution.

In this manner, a displacement amount of the vibration plate was measured for the samples 1 to 3 in which the piezoelectric element was formed on the vibration plate. A three-dimensional white light interference microscope manufactured by Bruker was used to measure the displacement amount. A deflection amount in a state in which no voltage was applied to the piezoelectric element and a deflection amount in a state in which a direct current voltage of 50 V was applied to the piezoelectric element were measured at room temperature. The displacement amount of the vibration plate was obtained by subtracting the deflection amount in a state in which no voltage was applied from the deflection amount in a state in which the voltage was applied.

The smaller the difference Δ in FIG. 6, the larger the displacement amount of the vibration plate would be. Therefore, it was known that when the difference Δ was less than 25.00°, the displacement amount of the vibration plate could be large compared with a case in which the difference Δ was 25.00° or more. In addition, it was known that when $y \leq -0.50x+25.21$, the displacement amount of the vibration plate could be large compared with a case in which $y > -0.50x+25.21$.

Here, when the $ZrO_2$ layer is formed by heat treating the Zr layer, the heat treatment is usually performed at about 850° C. as in the sample 3 before the piezoelectric element is formed so as to reduce the stress generated on the $ZrO_2$ layer. When the heat treatment is not performed, it may be difficult to accurately process the silicon substrate by a general semiconductor manufacturing device since the silicon substrate is warped by the stress generated on the ZrO2 layer.

The inventor found that the difference Δ could be made less than 25.00° and the displacement amount of the vibration plate could be made large by not performing the heat treatment for reducing the stress generated on the $ZrO_2$ layer as in the sample 1 and lowering the temperature of the heat treatment for reducing the stress generated on the $ZrO_2$ layer as in the sample 2.

In FIG. 6, the peak position derived from the (220) surface of the silicon substrate satisfies 2θ=47.03° and the peak position derived from the (100) surface of the PZT layer cannot be smaller than 2θ=22.23°. Therefore, the difference Δ is 24.80° or more.

Next, the state in which no voltage was applied to the piezoelectric element and the state in which a direct current voltage of 50 V was applied to the piezoelectric element were repeated a plurality of times on the samples 1 to 4 in which the piezoelectric element was formed on the vibration plate. Thereafter, the displacement amount of the vibration plate was measured by the same method as described above, and repetition characteristics of the samples 1 to 4 were evaluated.

The repetition characteristics rapidly deteriorated when the ratio Ti/(Zr+Ti) was larger than 0.55 in FIG. 6. Therefore, it was known that the repetition characteristics could be good by setting the ratio Ti/(Zr+Ti) to 0.55 or less.

In the present disclosure, some configurations may be omitted or the embodiment and the modification may be combined within a range having a feature or an effect described in the present application.

The present disclosure is not limited to the embodiment described above and various modifications can be made. For example, the present disclosure includes substantially the same configuration as the configuration described in the embodiment. The substantially same configuration is, for example, a configuration in which a function, a method, and a result are the same or an object and an effect are the same. The present disclosure includes a configuration in which a non-essential portion of the configuration described in the embodiment is replaced. The present disclosure includes a configuration having the same operation effect as the configuration described in the embodiment, or a configuration capable of achieving the same object. The present disclosure includes a configuration in which a known technique is added to the configuration described in the embodiment.

What is claimed is:

1. A liquid discharge head comprising:

a nozzle plate provided with a nozzle hole that discharges a liquid;

a silicon substrate provided with a pressure generating chamber that communicates with the nozzle hole;

a vibration plate provided on the silicon substrate; and a piezoelectric element that is provided on the vibration plate and changes a volume of the pressure generating chamber, wherein the piezoelectric element includes a first electrode, a piezoelectric layer formed on the first electrode that includes a composite oxide of a perovskite structure containing lead, zirconium, and titanium, and a second electrode formed on the piezoelectric layer, a difference between a peak position derived from a (100) surface of the piezoelectric layer and a peak position derived from a (220) surface of the silicon substrate in an X-ray diffraction of the piezoelectric layer is less than 25.00°, the (100) surface of the piezoelectric layer is a portion of the piezoelectric layer provided on the vibration plate that is not covered by the second electrode, and $y \leq 0.50x+25.21$ in which a ratio Ti/(Zr+Ti) of an atomic concentration of titanium to a sum of the atomic concentration of titanium and an atomic concentration of zirconium in the piezoelectric layer is x and the difference between the peak position derived from the (100) surface of the piezoelectric layer and the peak position derived from the (220) surface of the silicon substrate is y.

2. The liquid discharge head according to claim 1, wherein the ratio Ti/(Zr+Ti) of an atomic concentration of titanium to a sum of the atomic concentration of titanium and an atomic concentration of zirconium in the piezoelectric layer is 0.55 or less.

3. The liquid discharge head according to claim 1, wherein the difference is 24.80° or more.

4. The liquid discharge head according to claim 1, wherein the vibration plate includes a zirconium oxide layer.

5. A printer comprising:

the liquid discharge head according to claim 1;

a conveyance mechanism that moves a recording medium relative to the liquid discharge head; and a control unit that controls the liquid discharge head and the conveyance mechanism.

* * * * *